United States Patent [19]

Operschall et al.

[11] Patent Number: 4,632,740

[45] Date of Patent: Dec. 30, 1986

[54] APPARATUS AND METHOD FOR DECONTAMINATING METALLIC COMPONENTS OF A NUCLEAR ENGINEERING INSTALLATION

[75] Inventors: Hermann Operschall, Lauf; Hubert Stamm, Nuremberg, both of Fed. Rep. of Germany

[73] Assignee: Kraftwerk Union Aktiengesellschaft, Mülheim, Fed. Rep. of Germany

[21] Appl. No.: 676,717

[22] Filed: Nov. 30, 1984

[30] Foreign Application Priority Data

Nov. 30, 1983 [DE] Fed. Rep. of Germany ..... 3343396

[51] Int. Cl.[4] ..... C25F 3/16; C25F 7/00

[52] U.S. Cl. ..... 204/129.46; 204/129.95; 204/224 R; 204/276

[58] Field of Search ..... 204/129.1, 129.46, 129.6, 204/129.75, 224 R, 129.9, 129.95, 276

[56] References Cited

U.S. PATENT DOCUMENTS

| | | | |
|---|---|---|---|
| 2,539,455 | 1/1951 | Mazia | 204/129.46 |
| 3,326,785 | 6/1967 | Williams | 204/224 R |
| 3,751,343 | 8/1973 | Macula | 204/224 R |
| 4,318,786 | 3/1982 | Lahoda | 204/224 R |
| 4,401,532 | 8/1983 | Jackson | 204/129.1 |
| 4,431,501 | 2/1984 | Leppanen | 204/129.46 |

*Primary Examiner*—T. M. Tufariello

*Attorney, Agent, or Firm*—Herbert L. Lerner; Laurence A. Greenberg

[57] ABSTRACT

Apparatus for performing a method of decontaminating metallic components of a nuclear engineering installation by electropolishing with electrodes and an electrolyte liquid travelling in a circulatory loop during the decontamination, including a filter having a pore width of at most 1.5 μm, the electrolyte liquid being an aqueous solution having an electrolyte concentration of at most 20 percent by weight.

15 Claims, 1 Drawing Figure

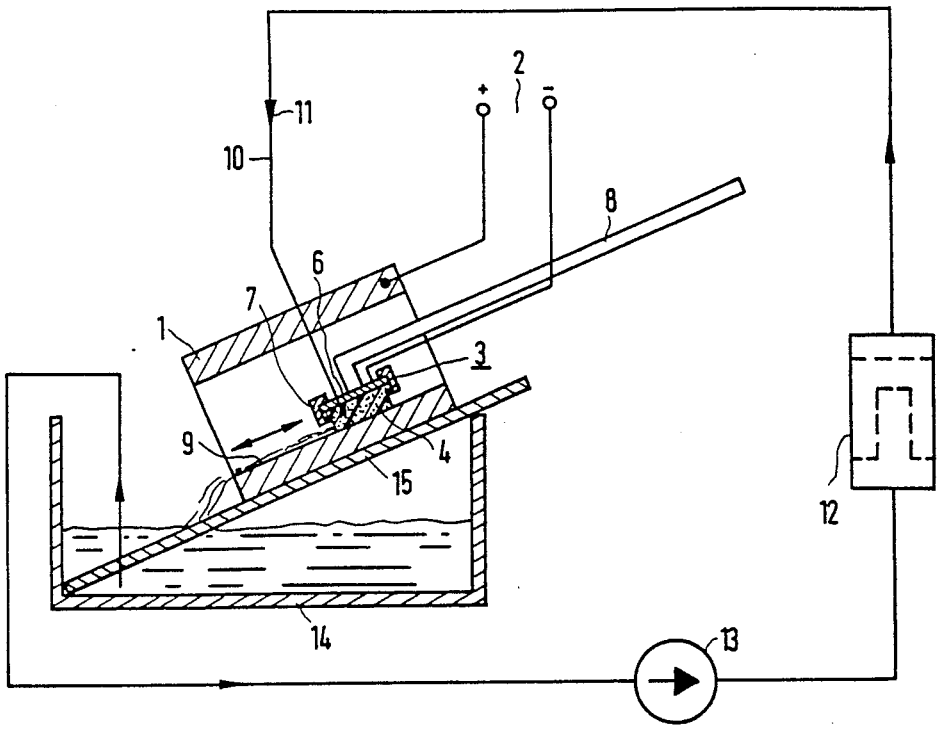
2
+
−
11
10
8
6
7
1
3
9
4
15
12
14
13

APPARATUS AND METHOD FOR DECONTAMINATING METALLIC COMPONENTS OF A NUCLEAR ENGINEERING INSTALLATION

The invention relates to an apparatus and a method for decontaminating metallic components of a nuclear engineering installation and, more particularly, by electropolishing with the aid of electrodes and an electrolyte liquid travelling in a circulatory loop during the decontamination process.

In U.S. Pat. No. 4,401,532, there is disclosed a process of decontamination, but no mention is made therein of how the electrolyte liquid is to be treated, after the decontamination process is completed, so as to prevent extensive accummulation of radioactive waste produced thereby, which must of course be removed while affording safety from radiation. The removal of the radioactive waste should furthermore be accomplished as simply as possible. Moreover, the new removal process should be such that the expense for chemical decontamination primarily with regard to the radioactive corrosion products, such as the gamma radiators, Co-58, Co-60, Cr-51, Mn-54, Zn-65, Sb-124 and Ce-144, for example, is markedly reduced.

With the foregoing and other objects in view, there is provided, in accordance with the invention, apparatus and method for decontaminating a metallic component of a nuclear reactor installation of the foregoing general type which employs a filter having a pore width of 1.5 μm or less and wherein the electrolyte liquid is an aqueous solution having an electrolyte concentration of at most 20 percent by weight.

By means of the apparatus and method of the invention, a reduction in the necessary quantity of electrolyte liquid is achieved because the liquid volume is purified by continuous filtration. An extensive concentration of activity carriers in the filter is attained. Thus, the electrolyte liquid can be introduced for longer periods and more often. Radioactive waste (secondary waste) is thus reduced. It is sufficient essentially, to remove spent filters in a manner which is safe from radiation. The invention has thus been found to have good decontamination results.

In realizing the invention, it has been found that filtering candles formed of material resistant to acid, especially plastic or synthetic material, are suited as the filters. Of great importance is the smallest possible pore width in order to be able to separate out the oxide particles dissolved in the electrolyte liquid. The pore width should be at most 1.5 μm. Even more desirable results are obtained with a filter having a pore width of 1.2 μm or less.

Because of the continuous purification less aggressive electrolyte liquids are able to be used with the invention. Therefore, different organic or inorganic acids of low concentration are involved. Lye may also be used. The electrolyte content in an aqueous solution need only be a small percentage by weight. Phosphoric acid with a concentration of from 8 to 15 percent by weight and particularly 10% by weight is especially suited for treating austenitic materials.

In addition to electrochemically dissolving the contaminated oxide layer on the metallic components, the decontamination can be amplified advantageously by mechanical action. In this regard, relative motion between the electrolyte liquid and the components can be produced ultrasonically, preferable in the kilohertz range. Furthermore, through a high electrolyte throughput, great flow velocities (>1 m/s) can be produced with an erosive effect upon the surface being decontaminated, especially by forming the flow cross section for the electrolyte throughput as narrow gaps. A further possibility is to move the electrolyte liquid, also with the aid of one of the electrodes, along the component. For this purpose especially, a trough-shaped electrode filled with wiping means is well suited. The electrode forms, together with the component, a chamber confining the electrolyte liquid. A synthetic sponge of polyester or polypropylene is used advantageously as the wiping means and carrier of the electrolyte liquid. A synthetic brush can also be used, however, in order to improve the mechanical action which contributes to breaking up the contaminated oxide layer.

The component to be decontaminated can be treated in a tub formed of synthetic or plastic material, from which the electrolyte liquid is conducted into the filter. This applies especially to the case wherein outer surfaces are to be decontaminated which, because of the shape of the surface thereof, cannot be so tightly enclosed with an electrode that practically no electrolyte liquid can escape. With components with a hollow space to be decontaminated, the hollow space can be closed up to an outlet for the electrolyte liquid so that the component itself is used as a container in a conventional manner. It is also possible, however, to combine both of them in order to avoid impurities through discharging electrolyte liquid.

The size of the trough-shaped electrodes depends upon the curvature of the surfaces being treated. Large-area electrodes may be used for low curvatures. On the other hand, it is also impossible, for increasing the totally effective electrode surfaces to drive a plurality of electrodes with a common voltage source and a common filter in parallel.

Other features which are considered as characteristic for the invention are set forth in the appended claims.

Although the invention is illustrated and described herein as embodied in apparatus and method for decontaminating metallic components of a nuclear engineering installation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a partly diagrammatic and schematic vertical sectional view of apparatus for performing the method of decontaminating a metallic component of a nuclear engineering installation, according to the invention.

Referring now to the drawing, there is shown therein a pipe section 1 to be decontaminated, which is connected as an anode to a d-c voltage source 2. The cathode is formed as a trough 3, which encloses a sponge member 4 formed of polyester material. The electrode 3 is made up, for this purpose, of a base plate 6 of circular cross section, and a beaded or flanged marginal strip 7 surrounding the base plate 6 and the sponge member 4, the latter projecting beyond the marginal strip 7. A handle 8 is attached to the base plate 6 and permits the electrode 3 to be guided manually along the inner surface of the pipe 1, so that the sponge member 4 wipes the inner surface 9 of the pipe 1 along the length thereof.

A line 10 extends through the base plate 6 and circulates phosphoric acid as electrolyte liquid having a concentration of 10 percent by weight in a loop in a direction represented by the arrow 11. The circulatory loop includes a filter candle 12 and an electrolyte pump 13, as well as a tub 14 formed of synthetic or plastic material, in addition to the sponge member 4, electrolyte liquid emerging from the sponge member 4 being sucked out of the tub 14. With the aid of a base support 15, the pipe section 1 is supported at an inclination above the synthetic tub 14 so that the electrolyte liquid flows off on one side.

The electrolyte liquid has a temperature of 25° to 40° C., because it is heated during the decontamination process. The current plane or area load is about 20 ampere/$dm^2$. If austenitic steel having German Engineering Norm (DIN) 1.4550 were treated, for example, with the foregoing values, 10 to 15 minutes being used for an area of 6 $dm^2$, a radiation load of more than 600 mR/h present before the decontamination is thus reduced to a value of less than 20 mR/h. The inner surface of the pipe then appears metallically clear or polished. The dissolved oxide layer is separated or deposited in the filter candle 12 having a pore width of $<1.2$ μm with 90 percent of the activity.

Before re-use, the pipe must be rinsed so that it is chemically neutral. This rinsing can be much less costly if a chemical conventionally provided during normal operation of the pipe 1, such as boric acid, for example, which is normally used in a pressurized water reactor for reactivity control, is introduced as the electrolyte.

The removal of the activity carrier is dissolved during the decontamination process, is effected with the invention by final storage of the filter candle 12 with conventional means. The electrolyte liquid per se can be maintained for further use.

There are claimed:

1. Apparatus for performing a method of decontaminating metallic components of a nuclear engineering installation by electropolishing with electrodes and an electrolyte liquid travelling in a circulatory loop during the decontamination, comprising a filter having a pore width of at most 1.5 μm, the electrolyte liquid being an aqueous solution of phosphoric acid and having an electrolyte concentration of from 8 to 15 percent by weight.

2. Apparatus according to claim 1 wherein at least one of the electrodes is trough-shaped, wiping means filling said one trough-shaped electrode and being movable with said one trough-shaped electrode along the metallic components, the electrolyte being entrainable by said wiping means and movable over the metallic components.

3. Apparatus according to claim 2 wherein said wiping means are made up of a fine-pore synthetic sponge formed of polyester or polypropylene.

4. Apparatus according to claim 2 wherein said wiping means are made up of an absorbent synthetic fleece formed of polyester or polypropylene.

5. Apparatus according to claim 1 including a synthetic tub wherein the components are receivable, the electrolyte liquid being guidable from said tub into said filter.

6. Apparatus according to claim 1 wherein a plurality of the electrodes have a common voltage source, said filter being a common filter with which said plurality of electrodes are connected in parallel.

7. In a method of contaminating a metallic component of a nuclear engineering installation, a step which comprises electropolishing the component with electrodes and an electrolyte liquid travelling in a circulatory loop during the decontamination, and passing the electrolyte liquid through a filter having a pore width of at most 1.5 μm, the electrolyte liquid being an aqueous solution of phosphoric acid with an electrolyte concentration of from 8 to 15 percent by weight.

8. Method according to claim 7 which comprises applying ultrasonic waves to effect relative movement between the electrolyte liquid and the component.

9. Method according to claim 7 which comprises passing the electrolyte liquid over the component with such throughput as to produce a high rate of flow in excess of one meter per second so as to have an erosive effect upon the surface of the component being decontaminated.

10. Method according to claim 7 which comprises moving one of the electrodes together with the electrolyte liquid along the component, the one electrode being trough-shaped and being filled with wiping means for guiding the electrolyte liquid.

11. Method according to claim 10 wherein the wiping means are made up of a fine-pore synthetic sponge formed of polyester or polypropylene.

12. Method according to claim 10 wherein the wiping means are made up of an absorbent synthetic fleece formed of polyester or polypropylene.

13. Method according to claim 7 which includes treating the component with the electrolyte liquid in a synthetic tub, and conducting the electrolyte liquid out of the synthetic tub and into the filter.

14. Method according to claim 7 wherein the metallic component is formed with a hollow space therein, and which includes closing the hollow space for receiving the electrolyte liquid therein, except for an outlet opening from which the electrolyte liquid is dischargeable.

15. Method according to claim 7 which includes providing the electrodes with a common voltage source, and connecting the electrodes in parallel with the filter in common.

* * * * *